United States Patent [19]

Suzuki et al.

[11] Patent Number: 4,687,419

[45] Date of Patent: Aug. 18, 1987

[54] VARIABLE ANGLE WOBBLE PLATE TYPE COMPRESSOR WHICH MAINTAINS THE CRANKCASE PRESSURE AT A PREDETERMINED VALUE

[75] Inventors: Shigeru Suzuki, Nishio; Masaki Ohta, Anjo; Kenji Takenaka, Kariya, all of Japan

[73] Assignee: Kabushiki Kaisha Toyoda Jidoshokki Seisakusho, Aichi, Japan

[21] Appl. No.: 812,247

[22] Filed: Dec. 23, 1985

[30] Foreign Application Priority Data

Dec. 28, 1984 [JP] Japan ..... 59-275214

[51] Int. Cl.[4] ..... F04B 1/26

[52] U.S. Cl. ..... 417/222; 417/270

[58] Field of Search ..... 417/222, 269, 270

[56] References Cited

U.S. PATENT DOCUMENTS

| | | | |
|---|---|---|---|
| 2,929,551 | 3/1960 | Heidorn | 417/270 |
| 3,062,020 | 11/1962 | Heidorn | 417/270 X |
| 3,861,829 | 1/1975 | Roberts et al. | 417/270 X |
| 4,037,993 | 7/1977 | Roberts | 417/222 |
| 4,073,603 | 2/1978 | Abendschein et al. | 417/222 |
| 4,145,163 | 3/1979 | Fogelberg et al. | 417/222 |
| 4,174,191 | 11/1979 | Roberts | 417/222 |
| 4,231,713 | 11/1980 | Widdowson et al. | 417/222 |
| 4,236,875 | 12/1980 | Widdowson | 417/222 |
| 4,428,718 | 1/1984 | Skinner | 417/222 |
| 4,526,516 | 7/1985 | Swain et al. | 417/222 |
| 4,533,299 | 8/1985 | Swain et al. | 417/222 |
| 4,543,043 | 9/1985 | Roberts | 417/222 |
| 4,586,874 | 5/1986 | Hiraga et al. | 417/222 |

FOREIGN PATENT DOCUMENTS

| | | | |
|---|---|---|---|
| 2019043 | 10/1979 | United Kingdom | 417/269 |
| 2155116 | 9/1985 | United Kingdom | 417/222 |

*Primary Examiner*—Carlton R. Croyle
*Assistant Examiner*—Paul F. Neils
*Attorney, Agent, or Firm*—Burgess, Ryan & Wayne

[57] ABSTRACT

A variable displacement compressor with a variable angle non-rotary wobble plate, having a control valve assembly which includes a pressure detecting unit for detecting a change in a pressure in the compressor crankcase and a single valve mechanism arranged in a communication passageway between the crankcase and the compressor suction chamber and able to control communication between the crankcase and the suction chamber in association with a pressure changing signal from the pressure detecting unit so that the pressure in the crankcase is maintained at a predetermined pressure value.

5 Claims, 5 Drawing Figures

VARIABLE ANGLE WOBBLE PLATE TYPE COMPRESSOR WHICH MAINTAINS THE CRANKCASE PRESSURE AT A PREDETERMINED VALUE

BACKGROUND OF THE INVENTION

1. Field of the Invention

The present invention relates to a variable displacement compressor. More particularly, it relates to an improvement of a variable angle wobble plate type compressor.

2. Description of the Related Art

A typical variable angle wobble plate type compressor adapted to be used in a vehicle airconditioning compressor is disclosed in U.S. Pat. No. 4,428,718. In the compressor, a control arrangement, having a valve mechanism biased by bellows and springs and responsive to both suction and discharge pressures, is provided to control the compressor crankcase pressure with respect to the suction pressure so as to change a wobble angle of a rotary drive plate on a drive shaft, thereby increasing or decreasing the compressor displacement, i.e., the discharge flow rate. When a cooling load, i.e., an air conditioning capacity demand, is lowered or when the compressor rotating speed is increased, a decrease in the suction pressure occurs. Thus, the bellows of the control arrangement are expanded, due to a change in the balance between the suction and atmospheric pressures, to operate the valve mechanism of the control arrangement. As a result, communication between the compressor suction chamber and crankcase is reduced, and alternately, communication between the compressor discharge chamber and crankcase is expanded so that the crankcase pressure is increased, thereby increasing a pressure differential between the suction pressure and the crankcase pressure. That is, a pressure acting behind the pistons of the compressor is increased resulting in a decrease in the length of stroke of the pistons. As a result, the suction pressure to the compressor is recovered, and the compressor displacement is decreased.

However, in the control arrangement of the above-mentioned typical conventional compressor, the valve mechanism is constructed so as to open and close both the communicating passageways between the suction chamber and crankcase and between the discharge chamber and crankcase. This makes the construction of the valve mechanism complicated. Also, when the compressor is rotated at a high speed and a high load is applied to the seal arrangement of the drive shaft, the crankcase pressure is increased. Therefore, the sliding portion of the seal arrangement of the drive shaft is subjected to a high surface pressure. As a result, the sealing performance as well as the physical durability of the seal mechanism must be lowered. The lowering of the sealing performance also occurs when the vehicle engine for driving the compressor suddenly speeds up. This is because, when the vehicle engine speed is rapidly accelerated, the suction pressure to the compressor is lowered and the above-mentioned control arrangement is operated so as to increase the crankcase pressure.

SUMMARY OF THE INVENTION

An object of the present invention is therefore to obviate the defects encountered by the conventional variable displacement compressor control arrangement.

Another object of the present invention is to simplify a control unit for changing an angle of wobble of a wobble and drive plate assembly of a variable displacement compressor with a variable angle wobble plate.

A further object of the present convention is to provide an improved variable displacement compressor in which a sealing arrangement disposed around a drive shaft of the compressor is not subjected to any unfavorable rise in pressure even if a rapid change in the running speed of the compressor occurs.

In accordance with the present invention, there is provided a variable displacement compressor with a variable angle wobble plate, which includes a suction chamber for a refrigerant to be compressed, a discharge chamber for a compressed refrigerant, a plurality of cylinder bores in which associated reciprocatory pistons are disposed so as to draw the refrigerant from the suction chamber and then discharge the refrigerant after compression to the discharge chamber, a closed crankcase for an assembly of wobble and drive plates to drive the reciprocatory pistons, and a control unit for changing an angle of wobble of the wobble plate in association with a pressure difference between a suction pressure in the suction chamber and a crankcase interior pressure, thereby changing a compressor displacement. The compressor is characterized in that the control unit comprises a pressure detecting unit for detecting a change in the crankcase interior pressure with respect to a predetermined pressure value, a communication passageway for providing a fluid communication between the suction chamber and the crankcase interior, and a valve mechanism arranged in a portion of the communication passageway and having a valve element operable to open fluid communication between the suction chamber and the crankcase interior in response to a signal from the pressure detecting unit indicating a rise in the crankcase interior pressure from the predetermined pressure value and to close fluid communication in response to a signal indicating a drop in the crankcase interior pressure from the predetermined pressure value, the predetermined pressure of the crankcase interior working on the pistons behind compression chambers of the cylinder bores to effect a decrease in the angle of wobble of the wobble and drive plate assembly.

Preferably, the pressure detecting unit, the communication passageway, and the valve mechanism of the control unit are accomodated in a single component capable of being assembled is the body of the compressor.

Also preferably, the control element of the valve mechanism of the control unit includes a ball valve assembly biased by a spring toward the fluid communication closing position.

BRIEF DESCRIPTION OF THE DRAWINGS

The present invention will be made more apparent from the ensuing description of the embodiments of the present invention with reference to the accompanying drawings, wherein.

DESCRIPTION OF THE PREFERRED EMBODIMENTS

The following description will be provided for the case where the present invention is embodied by a variable displacement compressor with a variable angle wobble plate, used for the purpose of air conditioning a car. That is, the compressor is driven by a car engine via an appropriate power transmission mechanism. However, it should be understood that the use of the compressor is not limited to only the air conditioning of a car.

Figure 1:
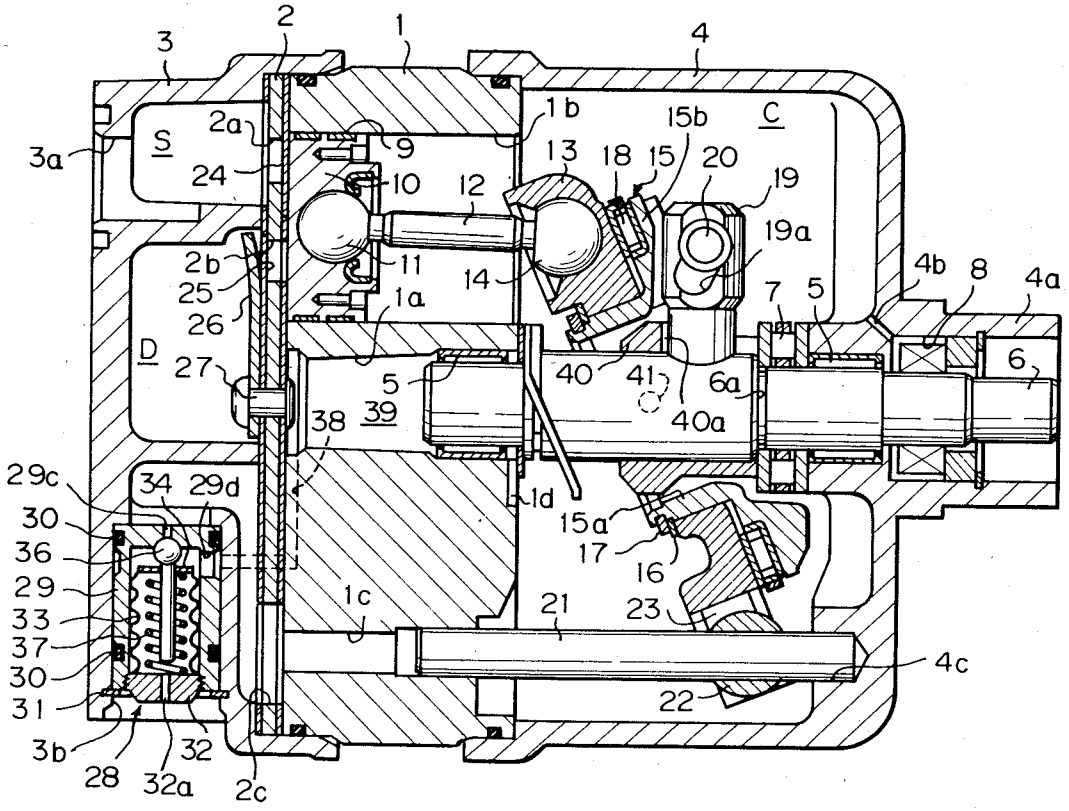
FIG. 1 is a vertical cross section of a variable displacement compressor with a variable angle wobble plate, according to an embodiment of the present invention.

Referring to FIG. 1, a variable displacement wobble plate type compressor includes a cylinder block 1 usually of cylindrical shape, having opposite open ends. One end of the cylinder block 1, i.e., the left open end in the drawing, is sealingly closed via a valve plate 2, by a head 3 having therein an annular suction chamber S formed with an inlet port 3*a* which is connected to an outer air conditioning circuit (not illustrated in FIG. 1) so as to receive a refrigerant gas returning from the circuit. The head 3 also has a centrally arranged discharge chamber D formed with a not illustrated discharge port which is also connected to the outer air conditioning circuit to deliver the refrigerant gas after compression.

The other end of the cylinder block 1, i.e., the right open end in the drawing, is fixedly and sealingly closed by a crankcase 4 having an interior C thereof for receiving therein a later described variable angle wobble plate 13. In the center of the cylinder block 1, a through-bore 1*a* is formed in which a radial bearing 5 is disposed so as to be axially opposed to another radial bearing 5 received in a cylindrical boss 4*a* provided for the center of the crankcase 4. The two radial bearings 5 rotatably support a drive shaft 6, one end of which, i.e., the right end, is operatively connectable to a car engine via an appropriate transmission system including, for example, a belt-pulley mechanism and a solenoid operated clutch. A thrust bearing 7 is disposed between a stepped end face 6*a* of the drive shaft 6 and an inner end of the cylindrical boss 4*a* of the crankcase 4. The cylindrical boss 4*a* is formed with a cavity as a drive shaft sealing chamber 8 which is communicated with the crankcase interior C by means of a passageway 4*b* bored through a part of the wall of the crankcase 4. The passageway 4*b* is provided as a lubricant passageway through which a lubricant is supplied to the sealing member within the sealing chamber 8.

The cylinder block 1 is formed with a plurality of axial cylinder bores 1*b* (In the case of the present embodiment, five cylinder bores 1*b*, only one of which appears in FIG. 1, are arranged) which are parallel with the drive shaft 6 and are arranged to be equiangularly spaced apart from one another on a circle about the axis of the drive shaft 6.

Each of the cylinder bores 1*b* is slidably fitted with a reciprocatory piston 10 having seal rings 9. The piston 10 has a compressing face opposed to the valve plate 2, i.e., the left end face, defining a compression chamber within the associated cylinder bore 1*b*, and a rear face opposed to the crankcase interior C, i.e., the right end face, to which an end of a connecting rod 12 is connected via a ball and socket joint 11. The other end of the connecting rod 12 of each piston 10 is connected, via a ball and socket joint 14, to the wobble plate 13 disposed so as to enclose the drive shaft 6. The wobble plate 13 is supported on a support cylinder 15*a* which is provided for a rotary drive plate 15 as a journal portion fitted in a central bore of the wobble plate 13. A thrust washer 16 and a retaining ring 17 are disposed at an outer end of the support cylinder 15*a* so as to limit any axial play of the wobble plate 13 on the support cylinder 15*a*, which bears against an annular flange portion 15*b* of the rotary drive plate 15 via a thrust bearing 18 intervened between a rear face of the wobble plate 13 and a front face of the annular flange portion 15*b*.

The drive shaft 6 has a fixed drive pin 19 radially projecting from the drive shaft 6 into the crankcase interior C. The drive pin 19 is operatively connected to the rotary drive plate by means of a connecting pin 20 engaged in a curved guide slot 19*a* formed in the drive pin 19. That is, the rotational motion of the drive shaft 6 is directly transmitted to the rotary drive plate 15 by means of the drive pin 19 and the connecting pin 20. Also, the rotary drive plate 15 is able to change an inclination thereof, with respect to a plane vertical to a rotating axis of the drive shaft 6 about the center of the connecting pin 20, under the guidance of the guide slot 19*a*. The change in the inclination of the rotary drive plate 15 correspondingly causes a change in the inclination of the wobble plate 13 resulting in an increase or decrease of the angle of wobble of the wobble plate 13 about an axis perpendicular to the rotating axis of the drive shaft 6. On the drive shaft 6 is axially slidably mounted a cylindrical sleeve 40 which is radially located on the inside of the suppport cylinder 15*a* of the rotary drive plate 15. The support cylinder 15*a* of the rotary drive plate 15 is pivotable about pivot pins 41 which are pivoted to an outer circumference of the sleeve 40. That is, the pivotal connection between the rotary drive plate 15 and the cylindrical sleeve 40 slidable on the drive shaft 6 permit the drive plate 15 as well as the wobble plate 13 to turn about the connecting pin 20 so as to change the inclination thereof. It should be noted that the cylindrical sleeve 40 is formed with an axially elongated aperture 40*a* through which the drive pin 19 radially extends.

The wobble plate 13 is provided with a ball guide 22 held by a shoe 23 radially movably arranged at the lowermost part of the wobble plate 13. The ball guide 22 is slidably fitted on an axial guide pin 21 bridged between a through-hole 1*c* of the cylinder block 1 and a blind bore 4*c* of the crankcase 4 so as to extend in parallel with the drive shaft 6. Therefore, the wobble plate 13 is prevented from being rotated together with the rotary drive plate 15. It should be noted that the above-mentioned through-hole 1*c* is communicated with the suction chamber S of the head 3 by means of a passageway 2*c* formed in the valve plate 2. The valve plate 2 is also formed with a plurality of suction ports 2*a* through which the refrigerant gas to be compressed is drawn into respective cylinder bores 1*b*. That is, the respective suction ports 2*a* are arranged so as to establish communication between the suction chamber S and respective compression chambers of the cylinder bores 1*b* via associated suction valves 24 when the respective cylinder bores 1*b* are subjected to a suction stroke by the associated pistons 10. The valve plate 2 is also formed with a plurality of discharge ports 2*b* for discharging the refrigerant gas after compression from the compression chambers into the discharge chamber D via associated discharge valves 25 backed up by a valve retainer 26 fixed to the valve plate 2 by means of a holding pin 27.

Figure 2:
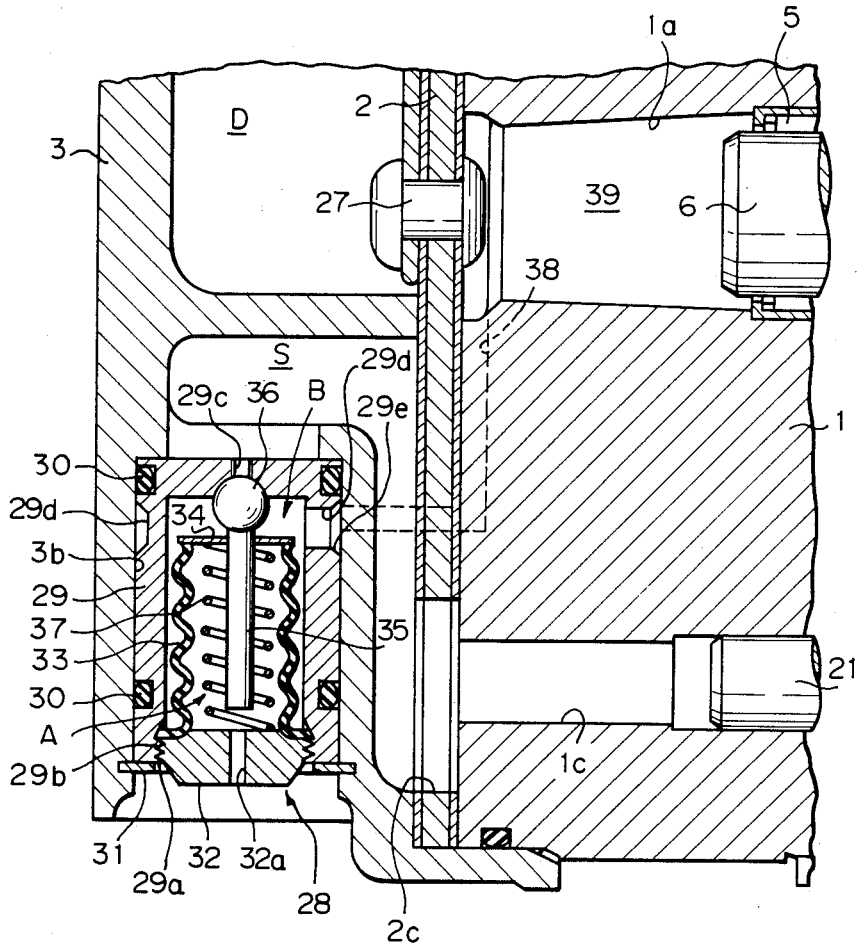
FIG. 2 is a partial enlarged cross sectional view of a control valve assembly and related portions of the compressor of FIG.1.

The variable displacement compressor of the present embodiment further includes a control valve assembly 28, a description of which will be provided hereunder with reference to FIG. 2.

The control valve assembly 28 is provided for maintaining a pressure Pc in the crankcase interior C at a set pressure Pco during the running of the compressor. The valve assembly 28 includes a cylindrical casing 29 having, at one end, a bottom face and at the other end, an opening. The cylindrical casing 29 is sealingly fitted in a cylindrical cavity 3*b* which is formed in a part of the outer circumference of the head 3 so as to be communicated with the suction chamber S. Seals 30 are provided to establish an air-tight connection between the casing 29 and the wall of the cylindrical cavity 3*b* of the head 3, and a retaining ring 31 arranged adjacent to the opening of the cylindrical cavity 3*b* is provided to place the casing 29 in position. The casing 29 is formed, at its opening, with a female threaded portion 29*a* in which a lid 32 having a central air passageway 32*a* is threadingly and fixedly engaged. Within the cylindrical casing 29, there is accommodated a bellows member 33 having an end, i.e. an outer end, fixedly and sealingly secured to a stepped portion 29*b* of the casing 29 by a screwing pressure applied from an inner face of the lid 32 to the stepped portion 29*b* of the casing 29. Another end, i.e., an inner end of the bellows member 33 is sealingly closed by a cap 34. Therefore, the interior of the cylindrical casing 29 is divided by the bellows member 33 and the cap 34 into two separate inner and outer chambers, i.e., an atmospheric pressure chamber A and a valve chamber B. A valve rod 35 axially extends from the atmospheric pressure chamber A into the valve chamber B and is air-tightly held by the cap 34. One end of the valve rod 35 is mounted with a ball valve 36 in the valve chamber B, and the opposite end of the valve rod 35 is positioned above the inner face of the lid 32 when the above-mentioned ball valve 36 is biased to the portion in which it closes a valve port 29C formed in the bottom of the casing 29 so as to communicate the suction chamber S and the valve chamber B. The biasing of the ball valve 36 toward the position at which it closes the valve port 29C is carried out by a coil-spring 37 disposed inside the atmospheric pressure chamber A.

The cylindrical casing 29 of the control valve assembly 28 is provided, at a part thereof adjacent to the bottom, with a through-hole 29*d* and an annular groove 29*e* fluidly connected to the through-hole 29*d* and extending around the outer circumference of the cylindrical casing 29. The annular groove 29*e* of the cylindrical casing 29 is fluidly communicated with an interior 39 of the through-bore 1*a* of the drive shaft 6 by means of a passageway 38 formed so as to extend through the head 3, the valve plate 2, and the cylinder block 1. The through-bore interior 39 of the drive shaft 6 is fluidly communicated with the crankcase interior C (FIG. 1) by means of a gap left in the radial bearing 5 and a radial groove 1*d* (FIG. 1) recessed in the inner face of the cylinder block 1 facing the crankcase interior C. Thus, the valve chamber B of the control valve assembly 28 is fluidly communicated with the crankcase interior C via the through-hole 29*d*, the annular groove 29*e*, the passageway 38, the through-bore interior 39 of the drive shaft 6, and the radial groove 1*d* of the cylinder block 1, so that a refrigerant gas may flow from the crankcase interior C into the valve chamber B of the control valve assembly 28.

With the control valve assembly 28, the opening and closing of the valve port 29*c* carried out by the aforedescribed ball valve 36 is controlled by the relationship among a suction pressure Ps prevailing in the suction chamber S, a pressure Pc prevailing in the crankcase interior C that corresponds to a pressure Pb prevailing in the valve chamber B, an atmospheric pressure Pa prevailing in the atmospheric pressure chamber A, and a pressure exerted by the coil spring 37 having a spring constant Ko and the bellows member 33. It should be understood, however, that since the opening area of the valve port 29C is small, the effect of the suction pressure Ps acting on the ball valve 36 is small and can be ignored, and that since the resilience of the bellows member 33 is extremely small, the effect of the pressure of the bellows also is small and can be ignored. Therefore, in practice, the opening and closing characteristics of the control valve assembly 28 can be determined by selecting the spring constant Ko in relation to the crankcase interior pressure Pc i.e., the valve chamber pressure Pb. For instance, it is possible to determine the opening and closing characteristics of the control valve assembly 28 in such a manner that when the crankcase interior pressure Pc approaches a predeterminded pressure value Pco, e.g., 2.5 times atmosphere, and thus, when the valve chamber pressure Pb correspondingly approaches the same predetermined pressure value Pco, the upward pressure consisting of the atmospheric pressure Pa and the force of the spring 37 overcomes the downward pressure acting on the cap 34 by the value chamber pressure Pb (=Pco), resulting in lifting the valve rod 35 and the ball valve 36 and thereby closing the valve port 29*c*.

In the embodiment of FIGS. 1 and 2, it should be appreciated that the control valve assembly 28 is so constructed that it can function not only as a pressure detecting means for detecting a change in the pressure Pc of the crankcase interior C but also as a valve mechanism for opening and closing the valve port 29C in response to a pressure signal detected by the pressure detecting means. That is to say, the pressure detecting means consists of the cylindrical casing 29, the lid 32, the bellows 33, the cap 34, the spring 37, the communication passageway extending from the valve chamber B to the crankcase interior C via the passageway 38, the through-bore interior 39, the radial groove 1*d* and the others, and the atmospheric pressure chamber A and valve chamber B, and the valve mechanism consists of the casing 29, the valve port 29C, the valve rod 35, the ball valve 36, and the valve chamber B.

The description of the operation of the variable displacement compressor with the variable angle wobble plate will now be provided hereunder with reference to FIGS. 1 through 4.

When the compressor is at a standstill, all interior pressures of the compressor, i.e., the suction pressure Ps, the crankcase interior pressure Pc, and the valve chamber pressure Pb, are all balanced at a constant pressure valve, e.g., 5 times atmosphere, which will be dtermined by the physical property of a refrigerant gas employed and so forth. Therefore, since the pressure Pb of the valve chamber B of the control valve assembly is higher than the pressure Pa of the atmospheric pressure chamber A, i.e., zero atmosphere, the bellows member 33 and the cap 34 holding the valve rod 35 and the ball valve 36 are collapsed by the differential pressure between the above-mentioned two pressures Pa and Pb against the force of the spring 37 so that the ball valve 36 is kept away from the valve port 29C.

When the compressor is brought into operation by the rotation of the drive shaft 6 driven by the car engine, the rotary drive plate 15 is rotated by means of the drive pin 19 and the connecting pin 20, resulting in the wobble motion of the non-rotary wobble plate 13 about an axis perpendicular to the rotating axis of the drive shaft 6. Thus, the pistons 16 are all reciprocated within the cylinder bores 1*b* by the wobble plate 13 via the associated connecting rods 12, so that the refrigerant gas drawn from the suction chamber S via the suction ports 2*a* is compressed in the compression chambers defined in repsective cylinder bores 1*b* by the front faces of respective pistons 16 and then the compressed refrigerant gas is discharged into the discharge chamber D of the head 3 via the discharge ports 2*b*.

The above-mentioned operation is that occurring at the commencement of the running of the compressor. Thus, the control valve assembly 28 is maintained at its opening position.

During the running of the compressor by the continuous drive from the car engine, a part of the compressed refrigerant gas will leak from the compression chambers of the cylinder bores 1*b* into the interior C of the crankcase 4 through small gaps between respective piston outer surfaces and cylinder bore inner surfaces as a blow-by gas. However, so long as the control valve assembly 28 is at its opening position, the blow-by gas flows through the radial groove 1*d*, the gap of the radial bearing 5, the interior 39 of the through-bore 1*a* of the drive shaft 6, the passageway 38 the through-hole 29*d*, the valve chamber B, and the valve port 29C into the suction chamber S. Thus, any rise in the pressure Pc of the crankcase interior C is prevented.

On the other hand, when the pressure Pc of the crankcase interior C drops to the predetermined set value Pco, the pressure Pb of the valve chamber B drops at the same time to the same predetermined set value Pco. As a result, the ball valve 36 of the control valve assembly 28 closes the valve port 29*c* due to the force of the spring 37. The closing of the valve port 29*c* intercepts the communication between the crankcase interior C and the suction chamber S. Accordingly, the above-mentioned blow-by gas leaking from the compression chambers into the crankcase 4 brings about a rise in the crankcase interior pressure Pc. As a result, when the pressure Pc in the crankcase interior C exceeds the predetermined set value Pco, the force acting to collapse the bellows member 33 while pulling the ball valve 36 away from the closing position is again effective. Consequently, the valve port 29*c* of the control valve assembly 28 is re-opened so as to communicate between the crankcase interior C and the suction chamber S. Thus, the pressure rise in the crankcase interior C is cancelled, and the predetermined set value Pco of the crankcase interior pressure Pc is recovered. It should be understood, accordingly, that by the repetition of the opening and closing of the ball valve 36, i.e., the adjustment of magnitude of opening of the valve port 29*c*, the control valve assembly 28 maintains the crankcase interior pressure Pc at the predetermined set value Pco during the running of the compressor.

Figure 3:
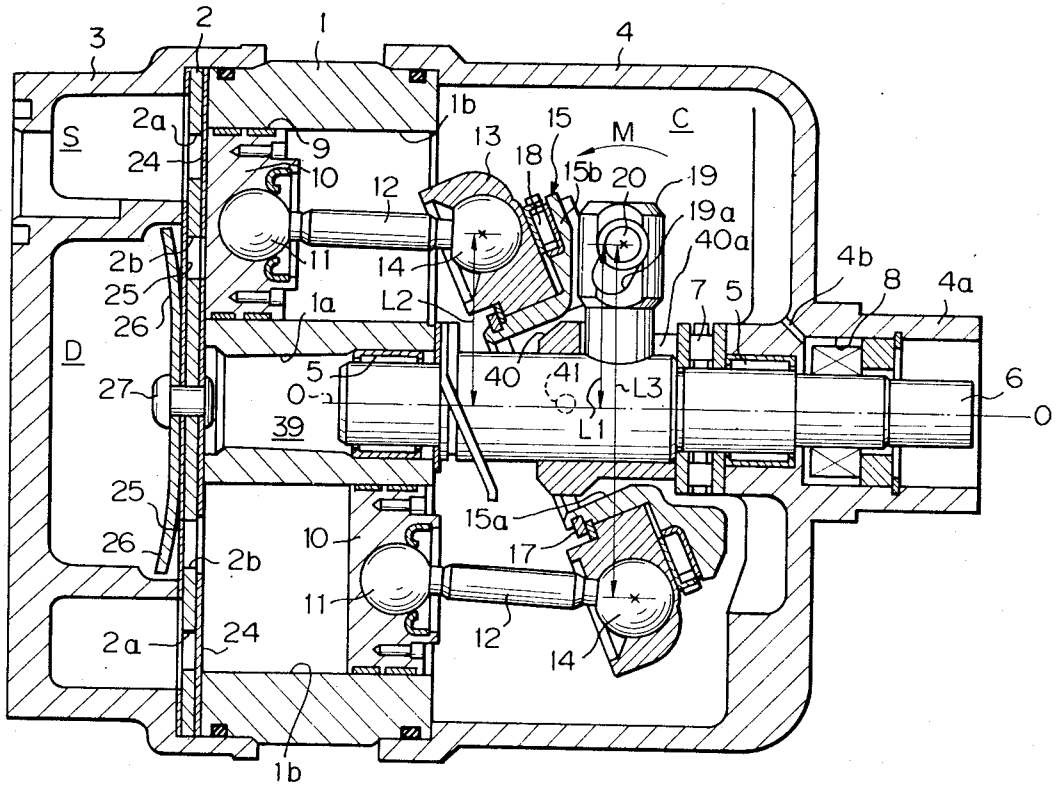
FIG. 3 is an another cross sectional view of the compressor of FIG. 1, illustrating the relationship between a wobble plate and only two associated pistons moved to two extreme positions, i.e., the top and bottom dead centers of their strokes.
Figure 4:
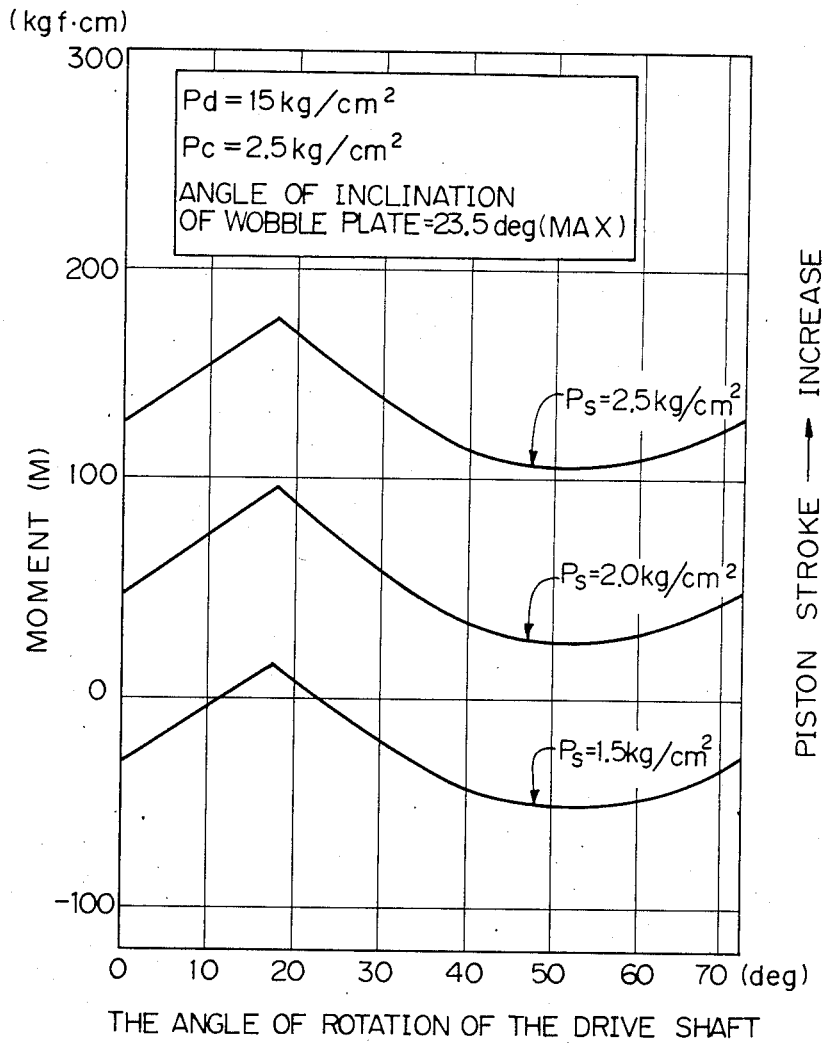
FIG. 4 is a graphic diagram illustrating the relationship between the moment (M) acting on the wobble plate and the angle of rotation of the wobble plate about the drive shaft axis.

Referring now to FIGS. 3 and 4, the motion of the non-rotary wobble plate 13 held on the rotary drive plate 15 during the running of the compressor will be described hereunder.

While the drive shaft 6 of the compressor is rotated about its own axis by the drive of the car engine, the drive pin 19 having the curved guide slot 19*a* is also rotated, passing through a plurality of positions (five positions in the present embodiment) at which the drive pin 19 comes into registration with the respective cylinder bores 1*b*. Everytime the drive pin 19 is in registration with one of the five cylinder bores 1*b*, the associated piston 10 is moved to the top dead center of its stroke as shown in FIG. 3. Each of the pistons 10 is also brought back from the top dead center of its stroke to the bottom dead center of its stroke, as also shown in FIG. 3, due to the wobble motion of the wobble and drive plates 13 and 15 during the rotation of the latter drive plate 15 and the drive shaft 6.

Also, the wobble and drive plates 13 and 15 are subjected to the reaction force from the piston 10 via the connecting rods 12. This reaction force will turn the wobble and drive plates 13 and 15 about the connecting pin 20, which is free to move in the curved guide slot 19*a*. Now, consideration is given to the moment M acting on the wobble plate 13 with respect to the connecting pin 20.

As illustrating in FIG. 3, the piston 10, which is moved to the top dead center of its stroke, receives on the front face (the compressing face) thereof a compression pressure, and on the rear face thereof facing the crankcase 4, the pressure Pc of the crankcase interior C. Therefore, the pressure difference between these compression and crankcase interior pressures Ps and Pc pushes the wobble plate 13 via the associated connecting rod 12 so as to lift the wobble plate 13 toward the vertical position. However, since the length $L_1$ from the rotating axis 0-0 of the drive shaft 6 to the center of the ball and socket joint 14 is approximately equal to the length $L_2$ from the same axis 0-0 to the center of the connecting pin 20, i.e., $L_1 - L_2 = 0$, the moment acting on the wobble plate 13 (the direction of an arrow M in FIG. 3 is considered as positive) is small and can be ignored.

On the other hand, with the piston 10 moved to the bottom dead center of its stroke, the length $L_3$ from the rotating axis 0-0 of the drive shaft 6 to the center of the ball and socket joint 14 is at its longest. The piston 10 receives, on the front face thereof, the suction pressure Ps and, on the rear face thereof, the pressure Pc of the crankcase interior C. Thus, the pressure difference $\Delta P$ between these suction and crankcase interior pressures Ps and Pc, i.e., Ps-Pc will apply a force to the wobble plate 13 to turn about the connecting pin 20. For example, if the suction pressure Ps is larger than the pressure Pc during the suction stroke of the piston 10, the wobble plate 13 will be subjected to a positive moment about the connecting pin 20. As a result, the wobble plate 13, per se, will operate to increase the length of stroke of the piston 10, increasing the angle of the wobble plate 13.

The other three pistons 10 except for the above-mentioned two pistons moved to the top and bottom dead centers of their strokes, are also moved to the respective positions of their strokes and subjected to respective pressure differences resulting from pressures acting on both front and rear faces thereof. The respective pressure differences apply turning moments to the wobble plate 13 about the connecting pin 20. Therefore, the wobble plate 13, per se, will be subjected to a total moment of the above-described five different moments about the connecting pin 20.

FIG. 4 illustrates a change in the above-mentioned total moment acting on the wobble plate 13 during the rotation of the drive shaft 6 through an angle of 72 degrees, which corresponds to the angle through which the top dead center position of the position moves from one to another cylinder bore of the five cylinder bores 1*b* of the present embodiment.

FIG. 4 also illustrates three different cases where, although the pressure Pc of the crankcase interior C is set at a predetermined pressure value of 2.5 $kg/cm^2$, the suction pressure Ps of the suction chamber S is varied to three different pressures, i.e., 2 $kg/cm^2$, 2.5 $kg/cm^2$, and 3 $kg/cm^2$, respectively. The discharge pressure Pd is maintained at 15 $kg/cm^2$. In FIG. 4, the abscissa indicates the angle of rotation of the drive shaft 6, and the ordinate indicates the total moment acting on the wobble plate 13 about the connecting pin 20. From FIG. 4, it will be understood that, in compliance with a decrease in the pressure Ps of the suction chamber S, the above-mentioned total moment M decreases, and that under the constant crankcase interior pressure Pco, a moment force is generated in association with the magnitude of the suction pressure Ps so as to change the angle of wobble of the wobble plate 13. That is, the wobble angle inclination of the wobble and drive plates 13 and 15 is controlled by the suction pressure Ps under the condition of a predetermined crankcase interior pressure Pco.

Momentarily, after the commencement of the compression operation, the suction pressure Ps rapidly drops from the balanced pressure at compressor standstill, e.g., 5 times atmosphere to 4 times atmosphere, due to the suction motion of the pistons 10. As a result, a pressure differences $\Delta P$ (Pc−Ps) appears between the crankcase interior pressure Pc and the suction pressure Ps. This pressure difference causes a decrease in the positive total moment M acting on the wobble plate 13, and therefore, a decrease in the length of stroke of the pistons 10. Thus, the compressor displacement, i.e., the discharge flow rate of the compressor is decreased. Thereafter, since the control valve assembly 28 is still at the opening position, and since a fluid communication between the suction chamber S and the crankcase interior C is established, the above-mentioned pressure difference is gradually reduced. That is, the crankcase interior pressure Pc becomes equal to the suction pressure Ps. However, during the continuous compression of the refrigerant by the pistons 10, a reaction force from the respective compression chambers applies, to the wobble plate 13, a total moment M which causes the wobble plate 13 to turn, thereby increasing the angle of inclination thereof. Accordingly, the length of stroke of the pistons 10 is increased. This increase in the length of stroke of the pistons 10 will cause a further increase in the moment M acting on the wobble plate 13. Consequently, the compressor begins its full displacement operation.

When both suction and crankcase interior pressures Ps and Pc drop together until the pressure Pc approaches the predetermined pressure value Pco (2.5 times atmosphere), the control valve assembly 28 is moved to its closing position, i.e., the valve port 29*c* is closed, as described before. That is, the crankcase interior pressure Pc does not drop below the predetermined pressure value Pco.

When the cooling operation of the compressor is excessive, and when the suction pressure Ps drops, a pressure difference appears between the suction pressure Ps and the crankcase interior pressure Pc. For example, when the suction pressure Ps drops to 2.0 times atmosphere, a pressure difference $\Delta P$ appears corresponding to −0.5 times atmosphere, which causes a negative moment M acting on the wobble plate 13. Thus, the length of stroke of the pistons 10 is decreased. Consequently, the compressor displacement is decreased.

Further, during the normal running of the compressor, if a sudden acceleration of the car engine occurs, so as to rapidly accelerate the drive shaft 6 of the compressor, the suction pressure Ps will immediately drop while generating a pressure difference $\Delta P$ between the pressure Ps and the crankcase interior pressure Pc. This pressure difference $\Delta P$ generates a negative moment M which decreases the length of stroke of the pistons 10, and accordingly, decreases the compressor displacement. Therefore, any increase in the engine load can be suppressed and the acceleration performance of the car engine is enhanced.

It will now be understood that the control valve assembly 28 is able to operate so as to maintain the crankcase interior pressure Pc at a predetermined pressure value Pco in association with an atmospheric pressure Pa in the atmospheric chamber A, regardless of a change in the suction pressure Ps in the suction chamber S. Thus, the sealing member in the shaft seal chamber 8 is always subjected to a constant surface pressure due to the predetermined pressure Pco prevailing in the shaft seal chamber 8 through the passageway 4*b*. That is, no deterioration in the performance of the sealing member occurs.

Figure 5:
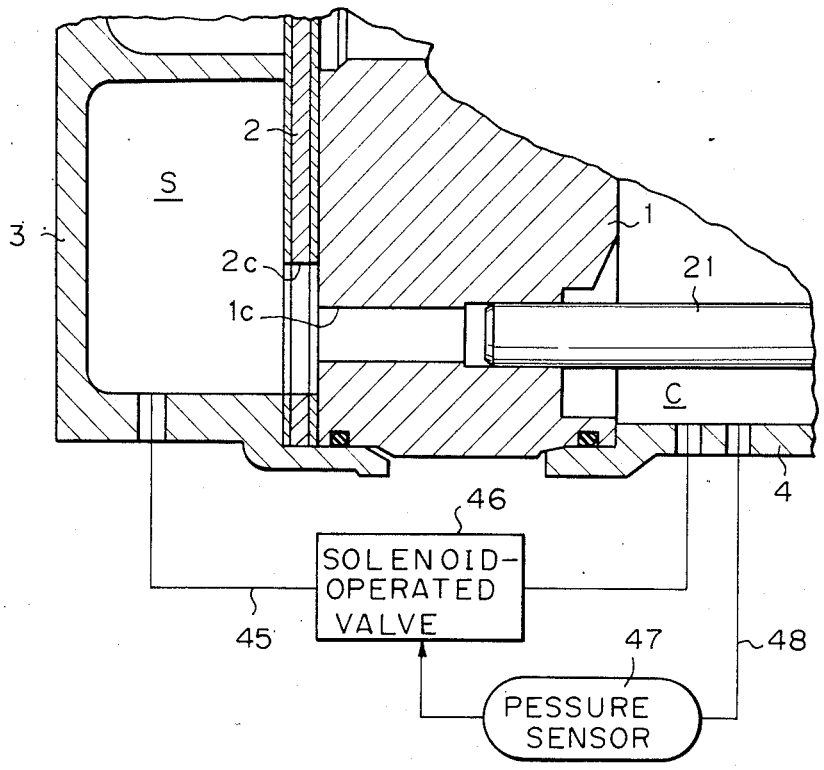
FIG. 5 a partial enlarged cross sectional view similar to FIG. 2 of a variable displacement compressor according to another embodiment of the present invention.

FIG. 5 illustrates another embodiment of the present invention, in which the suction chamber S and the interior C of the crankcase 4 are communicated with one another by a pressure conduit 45. In the pressure conduit 45 is accommodated a soleniod-operated valve 46, which is controlled by a pressure sensor 47 connected to the interior C of the crankcase 4 by a fluid conduit 48. The pressure sensor 47 detects a change in the pressure Pc in the crankcase 4. Therefore, the solenoid-operated valve 46 can operate so as to intercept the fluid communication between the suction chamber S and the interior C of the crankcase 4 when the pressure sensor 47 detects that the pressure Pc in the crankcase interior C drops to a predetermined pressure value Pco. On the other hand, when the pressure sensor 47 detects that the pressure Pc is above the pressure value Pco, the solenoid-operated valve 46 recovers the fluid communication between the suction chamber S and the interior C of the crankcase 4.

From the foregoing description of the preferred embodiments of the present invention, it will be understood that even if the rotation of the compressor is suddenly accelerated or a cooling load is so changed that the suction pressure is rapidly or gradually changed, the interior of the crankcase is kept at a predetermined constant pressure condition. Therefore, surface pressure of the sealing member of the shaft can be maintained at an optimum designed level. This brings about an enhancement of the sealing member of the compressor. Further, in accordance with the present invention, the construction of the control valve assembly accommodated in a variable displacement compressor with a variable angle wobble plate can be simplified.

It should be understood that modifications and variations will occur to a person skilled in the art without departing from the scope of the appended claims.

We claim:

1. A variable displacement wobble plate type compressor including a suction chamber for a refrigerant to be compressed, a discharge chamber for a compressed refrigerant, a plurality of cylinder bores in which associated reciprocatory pistons are disposed so as to draw the refrigerant from the suction chamber and then to discharge the refrigerant after compression to the discharge chamber, a closed crankcase for an assembly of wobble and drive plates to drive the reciprocatory pistons and a control means for changing an angle of wobble of the wobble plate in association with a pressure difference between a suction pressure in the suction chamber and a crankcase interior pressure thereby changing a compressor displacement, wherein said control means comprises:

built-in pressure detecting means for detecting a change in said crankcase interior pressure with respect to a predetermined pressure value including a casing member fitted in a cavity formed in a head in which said suction chamber is defined, a bellows member arranged inside said casing so as to define an atmospheric pressure chamber and a valve chamber separated from one another, and a spring member accommodated in said bellows member and having a preselected spring constant permitting said bellows member to be collapsed when said crankcase interior pressure introduced into said valve chamber via said passageway means approaches said predetermined pressure value;

passageway means for providing a fluid communication between said suction chamber and said crankcase interior and;

a valve mechanism arranged in a portion of said passageway means and having a valve element operable to open said fluid communication between said suction chamber and said crankcase interior in response to a signal from the pressure detecting means indicating a rise in said crankcase interior pressure from the predetermined pressure value and to close said fluid communication in response to a signal indicating a drop in said crankcase interior pressure from the predetermined pressure value, thereby maintaining said crankcase interior at the predetermined pressure value, the predetermined pressure of said crankcase interior working on said pistons behind compression chambers of said cylinder bores to effect a decrease in the angle of wobble of said wobble plate.

2. A variable displacement compressor according to claim 1, wherein said valve mechanism comprises:

a valve port formed in a bottom of said casing so as to communicate said valve chamber with said suction chamber; and a ball valve element held by said bellows member and biased toward said valve port by said spring member.

3. A variable displacement compressor according to claim 2, wherein said valve chamber of said pressure detecting means is communicated with said interior of said crankcase by said passageway means and communicatable with said suction chamber via said valve port, and wherein said atmospheric pressure chamber is communicated with the atmosphere.

4. A variable displacement compressor according to claim 3, wherein said ball valve element comprises a valve rod member connected to said bellows member and having an end thereof located in said valve chamber, and a ball connected to said end of said valve rod member.

5. A variable displacement compressor according to claim 1, wherein said passageway means comprise a part of said suction chamber, an aperture formed in a valve plate intervened between a head in which said suction chamber is defined and a cylinder block in which said cylinder bores are defined, a communication passageway formed in said cylinder block, a through-bore formed in said cylinder block to receive a drive shaft of said compressor, a gap of a drive shaft bearing, and a radial groove formed in a face of said cylinder block facing said interior of said crankcase.

* * * * *